United States Patent [19]

Bess

[11] 4,112,683

[45] Sep. 12, 1978

[54] CONTROLLED PULSE TURBINE ENGINE

[76] Inventor: Leon Bess, 433 B. S. 2nd Ave., Highland Park, N.J. 08904

[21] Appl. No.: 807,988

[22] Filed: Jun. 20, 1977

[51] Int. Cl.[2] ..... F02B 71/06; F02D 39/10

[52] U.S. Cl. ..... 60/595; 60/597; 73/507; 73/518; 123/46 R; 324/161

[58] Field of Search ..... 60/595, 597; 73/507, 73/518, 519; 123/46 R, 46 A, 46 B; 324/164, 167, 173, 161

[56] References Cited

U.S. PATENT DOCUMENTS

| | | | |
|---|---|---|---|
| 975,136 | 11/1910 | Kiely | 123/46 R X |
| 1,741,731 | 12/1929 | Nordensson | 123/46 R X |
| 2,581,600 | 1/1952 | Pescara | 60/595 |
| 2,779,156 | 1/1957 | Huber | 123/46 X |
| 2,963,008 | 12/1960 | Waldrop | 123/46 A |
| 3,787,769 | 1/1974 | Parkinson | 73/507 X |
| 3,932,989 | 1/1976 | Demetrescu | 123/46 R X |

FOREIGN PATENT DOCUMENTS

| | | | |
|---|---|---|---|
| 196,437 | 6/1938 | Switzerland | 123/46 |

*Primary Examiner*—Carlton R. Croyle
*Assistant Examiner*—Michael Koczo, Jr.
*Attorney, Agent, or Firm*—Arthur L. Plevy

[57] ABSTRACT

There is disclosed an engine which drives a turbine via a series of relatively identical hot gas pulses. The series of pulses are generated by a combustor-compressor unit under a controllable firing rate. The firing rate of the unit is rapidly variable over a wide range to enable one to drive the turbine and a shaft coupled to the turbine for propelling a vehicle. The combuster compressor is controlled to develop the gas pulses by a servo system which monitors the shaft rotation for varying mechanical loads to operate the turbine at a constant speed. A torque converter is employed to transform the shaft power into mechanical power necessary to propel a vehicle at conventional and required speed variations.

7 Claims, 9 Drawing Figures

Fig. 5A.
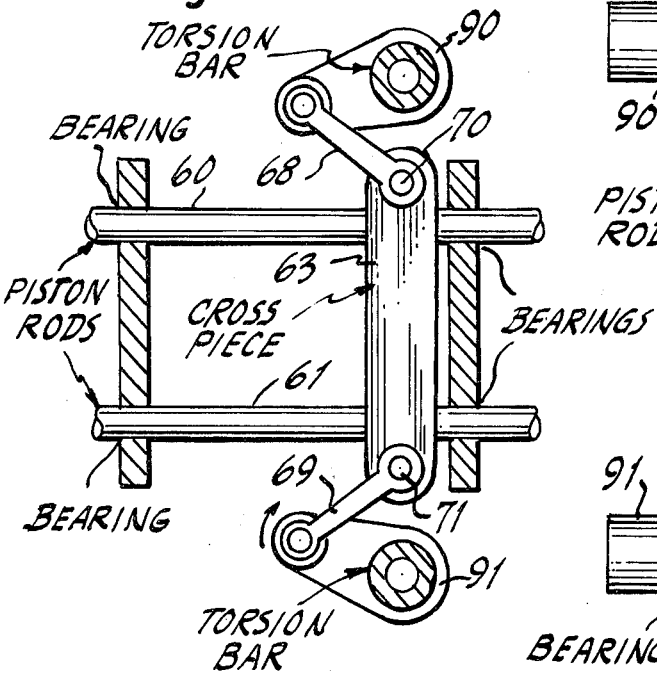
Fig. 5C.
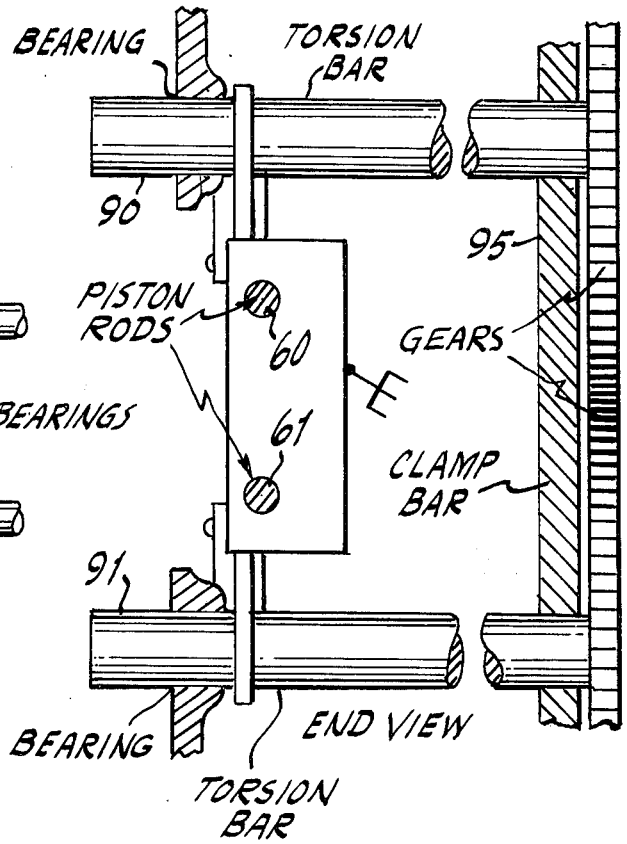
Fig. 5B.
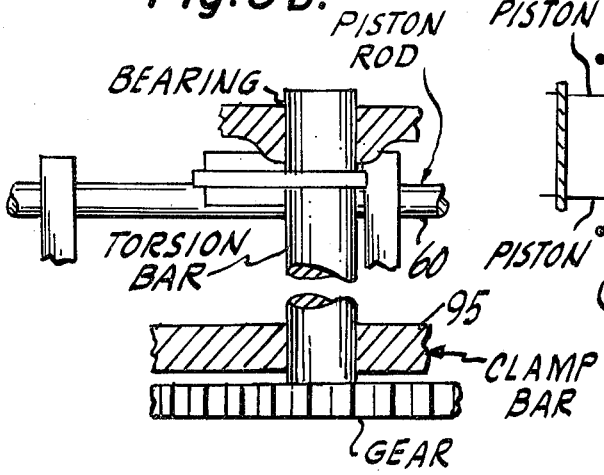
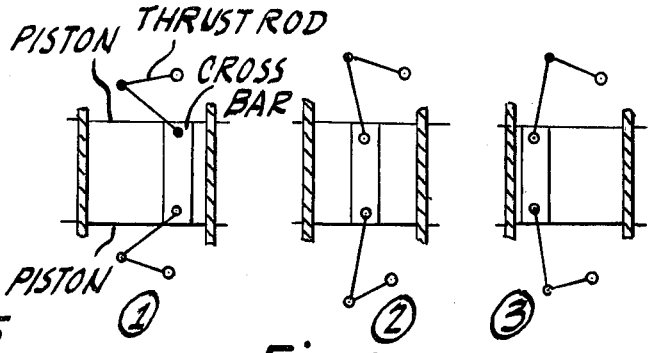
Fig. 5D.

CONTROLLED PULSE TURBINE ENGINE

BACKGROUND OF INVENTION

This invention relates to an engine apparatus and more particularly to a turbine engine which is controlled by a series of pulses of hot compressed gas.

There exists a great number of patents and technical article involved with and showing the use of turbine engines as a means for powering a motor vehicle such as an automobile. Presently, in view of the increasing fuel problems, there is a desire to provide a more efficient and economical engine while at the same time providing an engine which exhibits a decrease in exhaust pollutants.

A search of these classes reveal patents as U.S. Pat. No. 2,647,363 entitled COMBINED INTERNAL-COMBUSION ENGINE AND TURBINE by J. J. Scott patented on Aug. 4, 1953. The patent describes a turbine which is operated from the exhaust gas of an associated internal combustion engine. Various improvements on such concepts are shown in U.S. Pat. No. 3,990,242 entitled MOTOR VEHICLE DRIVE SYSTEM. Other patents such as U.S. Pat. No. 3,934,418 relate to turbine engines particularly adapted for automobiles. Patents as U.S. Pat. No. 3,112,357 shows various embodiments which employ compressors to compress gases by using a free piston machine. In any event, the area is quite crowded and turbine type engines in combination with internal combustion engines and diesel mechanisms have been described for various application.

It still remains a problem to provide an efficient low pollution engine employing a fewer number of moving parts.

BRIEF DESCRIPTION OF PREFERRED EMBODIMENT

A controlled pulse turbine engine comprises turbine means having a shaft rotatably coupled thereto for supplying power to a load, a combustor-compressor assembly having a piston assembly adapted to move in a relatively horizontal direction, said assembly comprising first and second actuatable high pressure cylinders each having a separate piston coupled to a crosspiece, a low pressure cylinder having a piston coupled to each of said high pressure pistons, and thrust control means coupled to said crosspiece for controlling said horizontal motion of said assembly, servo means operative to monitor the rotation of said turbine to develop a signal for activating either one of said high pressure cylinders to move said piston assembly in said horizontal direction as determined by said thrust control means, exhaust means coupled to said high pressure cylinder to provide a pulse at an output manifesting a charge of hot compressed gas generated by the motion of said high pressure piston within said cylinder, and means for applying said pulse to said turbine for rotation of said shaft.

BRIEF DESCRIPTION OF FIGURES

FIGS. 5A, 5B and 5C are respectively, a top, a side and an end view of an alternate embodiment of a thrust mechanism useful with this invention, while FIG. 5D is a simplified diagram showing the relative motion in three steps of the main moving parts of a thrust two piston assembly according to this invention.

DETAILED DESCRIPTION OF FIGURES

Figure 1:
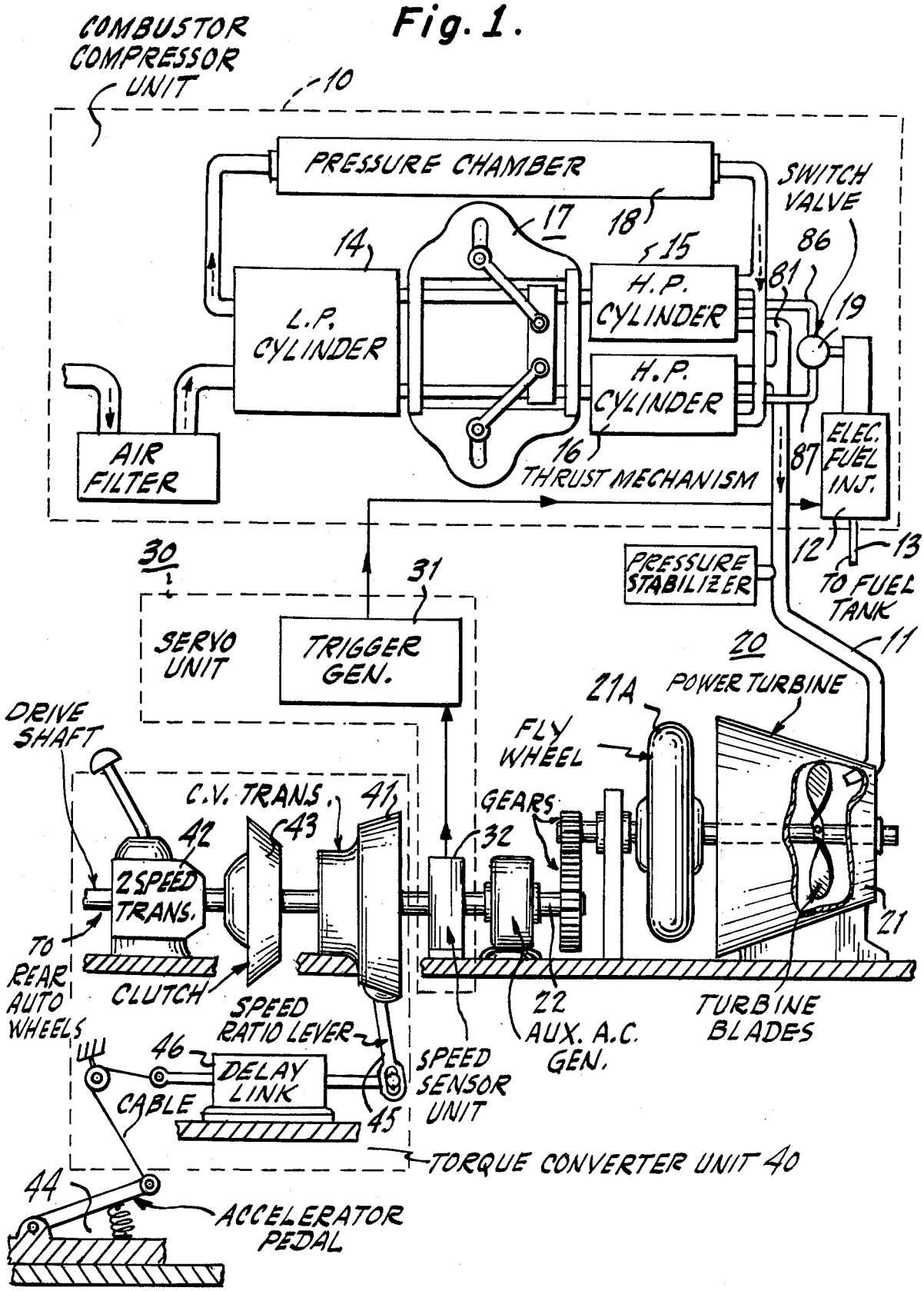
FIG. 1 is a schematic diagram partially in block form showing an engine according to this invention.

Referring to FIG. 1, there is shown a schematic diagram partially in block form of an engine design for an automobile or other vehicle, according to the present invention.

The engine apparatus of FIG. 1 basically consists of four main subsystems and will be described accordingly:

A combustor-compressor section 10, a power turbine assembly 20, a servo unit 30, and a torque converter unit 40.

The function of the combustor-compressor section 10 is to generate a series of narrow duration pulses of hot compressed gas that are employed to drive the power turbine 21 of the turbine assembly 20. The turbine 21 conventionally employs a rotor (not shown) which is rotated by the pulse train of hot compressed gas by means of a nozzle which couples the combustorcompressor section output 11 to the power turbine 21. The "firing rate" (the rate of gas pulses generated) is variable over a relatively wide range of from 30 firings per minute (fpm) to 4000 fpm. This rate may be varied rapidly from the maximum to minimum, specified above, in a relatively short time period (50 milliseconds).

The firing rate is developed and controlled by the servo unit 30, by means of a trigger generator 31 in conjunction with a speed or rotation sensor 32. The power output of the engine is directly proportional to this firing rate.

The sensor 32 is coupled to the rotor shaft 22 of the turbine section 20. The sensor 32 may be a rotation transducer as a photocell and detector, and monitors the speed of the rotor shaft 22 and provides an output pulse or electrical signal proportional to the speed. This signal is coupled to the trigger generator 31 which provides a narrow duration pulse (20 milliseconds) for application and control of the fuel injector 12 associated with the combustor-compressor unit 10. Thus, the servo loop afforded by the servo unit 30 consists essentially of the combustor-compressor 10, the turbine 20 and flywheel 21A, the sensor 32 and the trigger generator 31.

The servo system or loop is adjusted, for example, so that the turbine 21 rotates at a constant speed for all positive mechanical loads connected to the system. The ability to maintain constant speed increases the system efficiency by permitting the turbine to function at peak efficiency.

The turbine shaft 22 is mechanically coupled to the torque converter unit 40 via a continuously variable (C.V.) transmission assembly 41. The basic function of the torque converter system 40 is to transform the mechanical power of the turbine shaft 22 into mechanical power at any arbitrary speed as efficiently as possible. Essentially, the torque converter unit 40 comprises a two speed mechanical shift 42 including a clutch 43 and a continuously variable transmission 41. There are many examples of clutch and transmission assemblies in the prior art which can be employed herein.

For example of a suitable system, see an article entitled FLYWHEEL TRANSMISSION HAS VARIABLE SPEED GEAR in the March, 1977 issue of Automotive Engineering, pages 18 and 19, Volume 85, number 3. Other transmission assemblies are manufactured by DAF (of the Netherlands) and employed in the VOLVO 343. The DAF transmission has a speed ratio variation of five to one, and if used with a two speed manual shift 42, enables the torque-converter unit 40 to exhibit a speed ratio variation of more than 20 to one.

The automobile speed is conventionally controlled by an accelerator pedal 44 which varies the speed ratio of the transmission 41 via the speed ratio lever 45 associated with the transmission. The accelerator pedal 44 is coupled to the lever 45 via a mechanical delay link 46 operative to provide a smooth and continuous speed change as available on present autos.

It is interesting to note that since the turbine rotor 22 turns at constant speed (10,000 r.p.m. for example), there exists a store of kinetic energy which is large enough to supply peak power to the system for a reasonable interval (a few seconds). This implies that the servo unit 30 can be relatively slow-acting and hence, lends itself to a simple and economical construction.

The combustor-compressor unit 10 is a main component of the system and basically, operates as an internal combustion device which employs a quasi-diesel cycle and uses diesel fuel supplied by the fuel injector 12 coupled to the fuel tank 13 of the automobile.

The combustor-compressor unit employs a low pressure cylinder and piston 14 and two higher pressure cylinders and pistons 15 and 16 controlled in operation by a thrust assembly 17 coupled via a pressure chamber 18, as will be further described.

The primary reason for the overall increase in efficiency of this engine is that the unit operates relatively near peak efficiency, due to the fact that the turbine 21 by operating at constant speed, operates at peak efficiency. The combustor-compressor unit 10 uses the same air and fuel charge, as will be explained, for all mechanical loads. Also, the torque converter 40 always operates near peak efficiency. Hence, the average efficiency of the engine is greater than that of a conventional system.

In the following description, the various units briefly described above will be characterized in greater detail for a clear understanding of the invention.

THE TURBINE 20

The turbine unit 20 including the power turbine 21 is perhaps the simplest of the above engine components to specify and implement.

Essentially, once given the required power output, the speed of rotation, the temperatures and pressure of the input gas pulse, the turbine is specified and many existing units could be employed, as will be further explained.

THE SERVO UNIT 30

The servo unit employs a speed sensor 32 whose function is to generate a series of pulses having a repetition rate proportional to (*ws-wt*) where ws is the standard angular velocity (10,000 r.p.m.) and *wt* is the angular velocity of the turbine shaft 22.

Figure 2:
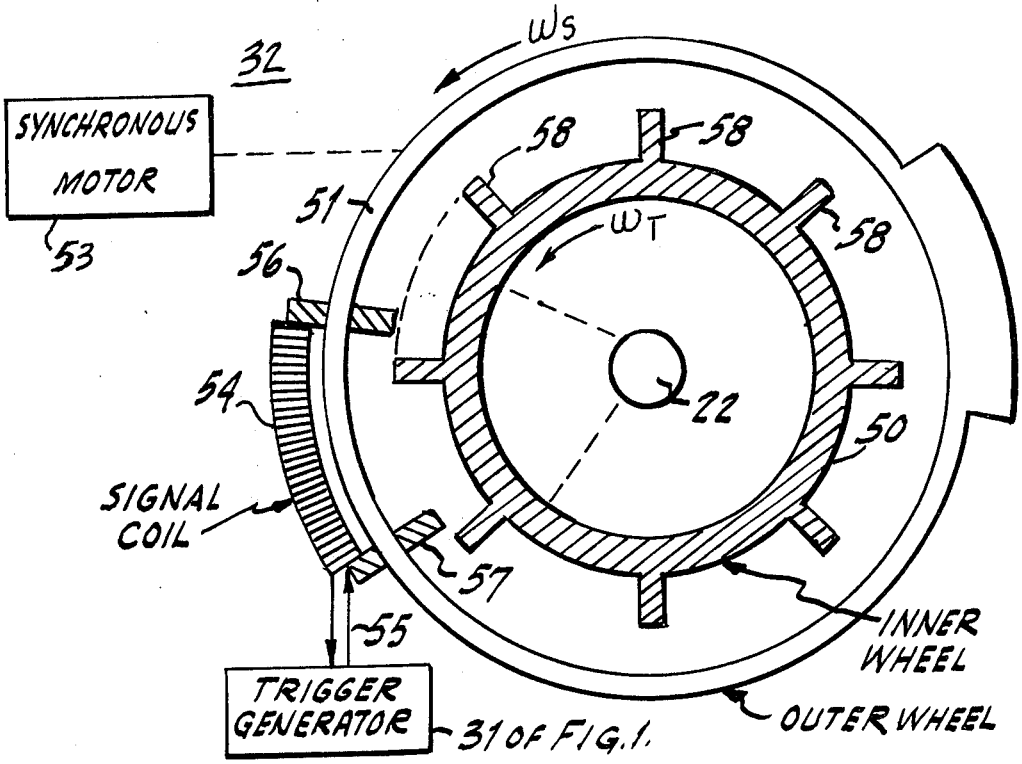
FIG. 2 is a schematic diagram depicting a particular type of speed sensing unit useful in this invention.

Referring to FIG. 2, there is shown a suitable arrangement for a speed sensor unit 32. An inner wheel 50 is geared or coupled directly to the turbine shaft 22 of the turbine 21 and rotates at the angular velocity *wt*. A concentric outer wheel 51 rotates at a constant angular velocity of ws and is driven by a small synchronous motor 53 at a speed as consistent with the desired turbine speed (10,000 r.p.m.). Essentially, the outer wheel is a standard source for determining the final speed. The inner wheel 50 is fabricated from a ferrite or other material having a high magnetic permeability. Located on the outer wheel 51 is a signal coil 54. The coil 54 is of conventional construction and consists of a number of turns of wire on a core of magnetic material. The output leads 55 from the coil 54 are directed to external circuitry as the trigger generator 31 via slip-rings or other conventional coupling devices. The coil 54 is directed between two terminals 56 and 57 having prong-like projections extending towards shaft 22. The inner wheel has a plurality of extending arms 58 equally spaced about the periphery thereof. Hence, the inductance of the signal coil 54 is dependent upon the relative position of the inner wheel 50 with respect to the outer wheel 51.

When the projections 58 of the inner wheel are aligned with projections 56 and 57 of the outer wheel, the inductance of coil 54 is maximum and is minimum when a projection 58 is midway between 56 and 57.

The ratio of minimum to maximum inductance can be quite large (10 to one) due to the magnetic circuit path and is indicative at the output as a series of narrow pulses with a repetition rate proportional to (*ws-wt*). The trigger generator 31 supplies a high frequency AC signal (100 KHz) to coil 54 and the magnitude of the signal (voltage) across the coil is proportional to the inductance. The trigger circuit 31 responsive to this signal would provide a pulse every time the voltage exceeded a predetermined level. Hence, the trigger circuit 31 could be a Schmitt trigger or a voltage sensitive monostable device. As can be seen, the speed regulation of the servo is a function of the standard angular velocity ws, the number of projections 58 on the inner wheel 50 and the time over which the stored kinetic energy of the system supplies peak power. Hence, if one employs eight projections as 58 about the inner wheel spread at 45° intervals and ws is proportional to 10,000 r.p.m., the system can provide speed control so that (*ws-wt*) is within 5 percent of *ws*.

THE COMBUSTOR-COMPRESSOR UNIT 10

Figure 3:
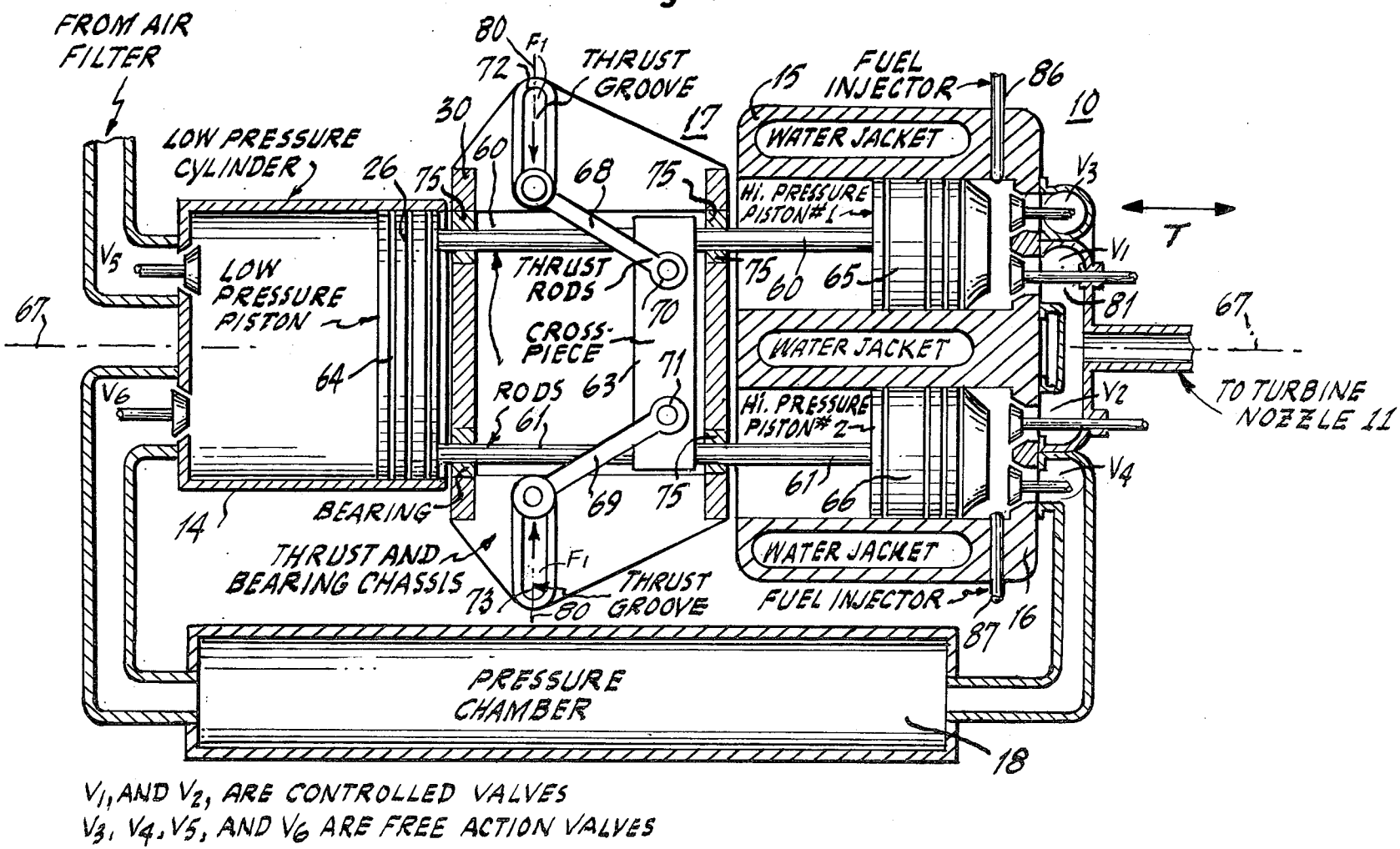
FIG. 3 is a detailed cross-sectional diagram showing combustor compressor unit.

Referring to FIG. 3, there is shown a schematic diagram of a combustor-compressor unit 10 with a particular type of thrust mechanism 17. It is noted that another embodiment of a thrust mechanism will be briefly described as well.

Before describing the apparatus of FIG. 3, it is noted that the two high pressure cylinders (HP), 15 and 16, the low pressure cylinder (LP) 14 and the thrust and bearing chassis 17 are all rigidly secured to the frame of the vehicle to be propelled via shock absorbers and so on; or in turn are affixed to a rigid bed and thence, to the auto frame. There is shown two piston rods 60 and 61 which are secured to a cross-piece member 63 and also attached or coupled to a piston 64 associated with the low pressure cylinder 14 and pistons 65 and 66 associated with the high pressure cylinders 15 and 16.

Thus, the piston assembly consisting of rods 60 and 61, the crosspiece 63 and the L.P. piston 64 and H.P. pistons 65 and 66 move as an assembly or unit. Since the rods 60 and 61 are constrained by bearings 75 in chassis 17, the assembly moves only in the direction of the center line 67. The cross-piece 63 is coupled to the chassis 17 by thrust rods 68 and 69. Each thrust rod 68 and 69 is coupled to the cross-piece 63 by a pivotal joint 70 and 71. The other end of the thrust rods 68 and 69 "ride" in thrust grooves 72 and 73 in chassis 17. The thrust mechanism thus depicted consists of the thrust rods 68 and 69 which freely pivot at junctures 70, 71 and within slots 72 and 73 at each end.

Due to the constraints afforded by the grooves 72 and 73, the ends of the rods 68 and 69 can move vertically along line 80 according to the length of the grooves 72 and 73. The pivot points 70 and 71 are rigidly attached to the crosspiece 63. Hence, if a force F and F' which are equal and opposite forces, were applied along vertical line 80 to the ends of the thrust rods 68 and 69, a thrust force T is applied along center line 67 and in a right or left direction. The mechanism for generating forces F and F' is not shown but can be provided by a simple biased spring arrangement. Assume that the thrust mechanism as controlled by forces F and F' is to move to the left of mechanical equilibrium for operation according to present purposes. Hence, as the piston assembly moves left, the thrust force T decreases and reaches zero when the points 70 and 71 are along vertical line 80.

Before proceeding with a further description of FIG. 3, a general explanation of operation of the combustor-compressor unit 10 is believed to be warranted.

Assume that the unit is operating and is running at a low constant rate with a low number of firings per minute (fpm). The operation will be examined in the interval between successive "firings" with the piston assembly in mechanical equilibrium as shown in FIG. 3. Assume the H.P. cylinder 15 has a charge of totally compressed air (18 atmospheres) and the pressure chamber 18 is filled with partially compressed air (3.4 atmospheres, 85psi) and the L.P. cylinder 14 is filled with air at atmospheric pressure. Hence, to maintain the piston assembly in mechanical equilibrium, an additional force to the right is required and this is supplied by the thrust force T. When fuel is injected into the H.P. cylinder 15 by a "firing", the pressure builds up and forces the piston assembly to move to the left. It moves a few inches (3 inches) before it is stopped by the pressure force on the L.P. piston 64 and the thrust force T. During the motion to the left, (outward excursion), the action of the L.P. piston 64 and valves V5 and V6 at the air filter and pressure chamber outlets, forces a charge of air (at 85psi) and with a volume equal to the air placement of an H.P. cylinder. At the same time, an equal quantity of air (85psi) is transferred from the pressure chamber 18 to the other H.P. cylinder 16. Thus, the outward excursion of the piston assembly represents the power stroke of the H.P. cylinder 15 and the intake stroke of the H.P. cylinder 16, while the pressure chamber maintains pressure at 85psi.

When the piston is brought to a stop at the maximum excursion to the left, there is still air left in the low pressure cylinder 14 sufficient to create a pressure force on the L.P. piston 64. This force and the residual thrust force T will move the piston assembly back to the right after a momentary rest. At the inception of this movement to the right, the valve V1 opens and the charge of hot compressed gas will be forced by the H.P. piston 65 into the exhaust pipe 81 and thence, via pipe 81 to the nozzle 11 of the turbine. Thus, a pulse of hot compressed gas is sent to the turbine to "drive" the blades. At this time, the charge of air in H.P. piston 66 is being compressed to go from a pressure of 85psi to 860psi (18 to one compression ratio). It is mainly the high pressure on piston 66 arising in the rightward movement that brings the piston assembly to a stop at the equilibrium position. In this position, the HP cylinder 16 has the compressed charge instead of cylinder 15 and as was the case before "firing". In the return motion of the piston assembly, the cylinder 15 underwent an exhaust stroke while cylinder 16 underwent a compression stroke. After returning to the equilibrium position, all action will stop until the next firing. In the system, the firing is controlled by the fuel injector 12. As seen in FIG. 1, the injector 12 is associated with a valve 19. The valve 19 is switched to cause fuel to be injected into H.P. cylinder 15 or 16 via ports 86 and 87 of FIG. 3. Hence, upon the next firing, the H.P. cylinders 15 and 16 exchange roles and the cycle above-described continues. The fuel is ignited by the heat in the piston or by a spark.

Briefly, the events described and indicative of the outward excursion and return motion are denoted as an action cycle. The action cycle for this engine takes place in an interval between 15 and 40 milliseconds. As soon as the cycle is completed, the system is ready for the next cycle which could be commenced at any time. It is seen that the generation rate of the "hot gas pulses" into the nozzle of the turbine is determined by the "firing rate".

Figure 4A:
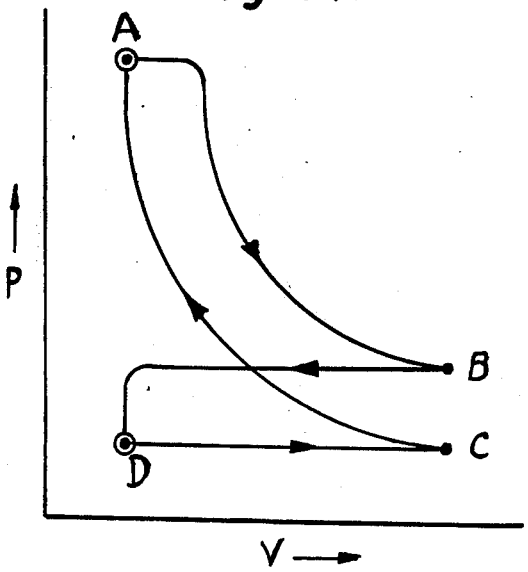
FIGS 4A and 4B are PV diagrams useful in explaining the operation of this invention.

Referring to FIG. 4A, there is shown a thermodynamic plot of pressure versus volume (P-V) as related to the operation of the combustor-compressor unit 10.

The encircled points A and D represent the position of mechanical equilibrium of the compressor-combustor 10 at the beginning of an action cycle. Point A represents the PV state of H.P. cylinder 15 and point D represents the state of cylinder 16.

As indicated, the action cycle is started by the firing of the compressor-combustor and the piston assembly undergoes its outward excursion. The change of state for H.P. cylinder 15 is represented by the curve between points A and B, which is the power stroke for the system. At the same time, the change of state of H.P. cylinder 16 is represented by the curve between points D and C, which corresponds to the intake stroke. In the return motion of the piston assembly, the curve between points B and D represents the change of state for cylinder 15. This corresponds to the exhaust stroke which provides the gas pulse for the turbine nozzle. The change of state for cylinder 16 is represented by the curve between points C and A and is the compression stroke. With cylinder 15 at point D and cylinder 16 at point A, the action cycle comes to an end and the roles of the cylinders are then reversed and hence, will traverse the curve of FIG. 4A upon the next firing of cylinder 16 functioning as cylinder 16 and vice versa.

It is noted that the intake pressure in regard to the above noted system which would correspond to the pressure at point C, is approximately 3.4 atmospheres and the pressure over most of the exhaust stroke is significantly higher than this.

It is seen from the curve that the pressure between points B and D representing the exhaust stroke is relatively constant. Keeping the pressure constant over the exhaust stroke is necessary for efficient operation of the turbine.

For optimum efficiency, the average flow velocity of the gas emanating from the turbine nozzle should be constant over the duration of the gas pulse. Hence, the gas pressure at the input of the turbine nozzle should be constant. This means that the exhaust stroke should occur at constant pressure. It is seen that the curve between points B and D of FIG. 4A fulfills this condition which is accomplished with the aid of the pressure stabilizer unit of FIG. 1.

Figure 4B:
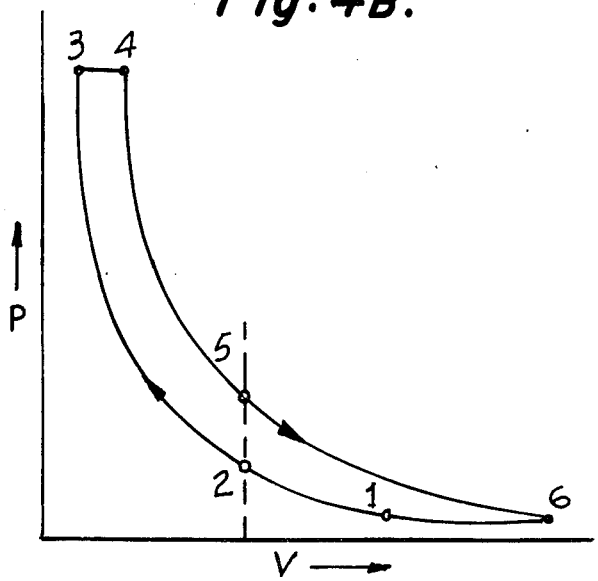

Referring to FIG. 4B, there is shown a PV diagram which represents the thermodynamic functioning of the entire engine assembly. In plotting the FIGURE, the assumption is made that the turbine is one hundred percent efficient.

In FIG. 4B, a curve going through the sequence of points 2,3,4,5 represent the functioning of the H.P. cylinder of the compressor-combustor and is relatively the same operation as of points C,A,B of the curve of FIG. 4A. The 1–2 portion of the curve in FIG. 4B represents the operation of the L.P. cylinder 14 which forces compressed air into the pressure chamber 18. The pressure at point 1 of FIG. 4B is about 15psi while the pressure at point 2 is approximately 85psi. The 5–6 portion of the curve of FIG. 4B represents the functioning of the turbine where the exhaust pressure P6 is also about 15psi or atmospheric pressure.

As indicated above, the overall compression ratio of the compressor-combustor is chosen to be about 18 with the H.P. cylinder compression ratio about 5.3 and the L.P. compression ratio about 3.4. Based on information from thermodynamic calculations, it can be shown that the temperature and pressure at point 5 can be controlled by varying the compression ratio of the H.P. and L.P. cylinders while keeping the overall compression ratio constant by varying the amount of injected fuel. Therefore, a high temperature limit for the turbine is specified.

The ideal thermal efficiency of the system can be derived from the curved of FIG. 4B and approaches the value of 68.5 percent. This value is, of course, an ideal value and the practical system would exhibit an efficiency somewhat lower than this.

It can also be shown that the most critical adjustment in the entire engine is involved in the regulation in the amount of fuel injected into the H.P. cylinders 15 and 16 during the firing of the turbine. Hence, FIG. 1 shows an electric fuel injector 12 where an impulsive force applied to the injector piston is generated by an electromagnetic solenoid. The fuel charge is then varied by varying the current pulse to the solenoid. It is noted that the timing of the fuel injection is not critical.

Referring back to FIG. 3, it is seen that valves V-3, V-4, V-5 and V-6 are free action valves which indicate that they act automatically when a certain pressure difference exists between their input and output sides. Such free acting valves manifests little maintenance and make for a reliable system.

An advantage of the combustor-compressor is that the intake valves V-3 and V-4 are free acting rather than controlled valves and impart more reliability to the system and this operation is enabled as shown in FIG. 4A as the exhaust stroke takes place at a much higher pressure than the intake stroke. Only the two exhaust valves V-1 and V-2 are controlled valves and can be simply activated by the use of a cam system or similar device as employed to control valves in the conventional engine.

Essentially, the valve V-1 opens just prior to the system reaching point B of FIG. 4A and closes just before point D. During this operation, valve V-2 remains closed. In the subsequent operation involving H.P. cylinder 16, valve V-2 would open between points B and D and valve V-1 would remain closed.

The action of the valves V-1 and V-2 are relatively simple and is a dual action which provides for the operating of one of the valves during the operation of one H.P. cylinder and a switch from one valve to the other. This control can be governed electronically or otherwise and the same sequence which is used to switch the valves can operate the switch valve 19 of FIG. 1 to enable fuel injection into the proper cylinder.

It is noted by referring to FIG. 3 that the engine can be water cooled by incorporating water conducting jackets about the cylinders 15 and 16 and so on, as is known.

As briefly indicated above, the torque converter 40 can be implemented by many existing configurations and such converters including the clutch and transmission assemblies are well known in the art as well as continuously variable transmission devices which can provide the functions of the mechanical torque converter. In this type of engine, when employed with a mechanical torque converter, the auto can be slowed down just by removing pressure from the accelerator pedal 44 to provide regenerative braking. In this system, the use of the accelerator pedal causes the turbine rotor and the associated flywheel 21A to speed up above say 10,000 r.p.m. as no gas pulses would be fed to the turbine when this rate is exceeded. Hence, the energy derived from slowing down the auto is stored as kinetic energy in the flywheel instead of being dissipated. The net effect of this action would be to increase fuel mileage in crowded urban areas and this increase could be close to thirty percent.

Referring to FIG. 5, there is shown another embodiment for the thrust and piston assembly of FIG. 3 wherein similar functioning parts have retained the same numerals.

In this embodiment, the thrust rods 68 and 69 are again secured to a cross-piece 63 at points 70 and 71 and are coupled to the chassis at the other end by means of torsion bar assemblies 90 and 91. The action of the torsion bar mechanism provides the same relative motion of the piston assembly 60 and 61 as described in conjunction with the mechanism shown in FIG. 3.

FIG. 5A is a top view of the piston assembly with the torsion bars; while FIG. 5B is a side view of the assembly with FIG. 5C being an end view of the assembly.

In this configuration, the movement of the torsion bars which is generally depicted in FIG. 5D, is seen to be analgous to the mechanism shown in FIG. 3 employing the thrust grooves in the chassis. The piston rods traverse from left to right as above indicated due to the action of the torsion bar assemblies 90 and 91.

It can be seen from FIG. 5C in particular, that the two torsion bars are interconnected with gears to assure that the torsion developed in both bars is equal to each other.

FIG. 5D is a simplified diagram showing steps 1,2 and 3 indicative of the relative positions of the main moving parts during the various stages of the action cycle and in general depict the operation of the thrust mechanism as also described in conjunction with FIG. 3.

As indicated above, one of the main purposes of the thrust mechanism shown in FIGS. 5 and 3 is to counteract the pressure forces due to the compressed air in one of the H.P. cylinders. Hence, the H.P. piston associated with that cylinder is held in place to retain the compressed air between it and the cylinder until it is ready to be fired.

It would be known to one skilled in the art how to implement the assembly described in FIG. 5 employing a torsion bar mechanism in lieu of the mechanism depicted in FIG. 3.

ADDITIONAL COMMENTS

It is noted that in this particular type of system, the average efficiency of the engine is relatively close in value to the peak efficiency because the turbine rotates relatively at the same speed. In conjunction with this, is the fact that the fuel charge injected into a high pressure cylinder and the charge of air in this cylinder remains relatively the same regardless of the external mechanical load.

In essence, the peak efficiency of this engine is not much greater than that of a conventional gasoline internal combustion engine. However, the average efficiency of this engine is perhaps twice that of the conventional engine since the described engine operates at nearly the same efficiency for all of the various traffic conditions which is not true of the internal combustion engine.

The levels of HC and CO pollutants are lower than those of a conventional engine due to the longer time of burning characteristic of turbines. The NOx pollutants would also be somewhat lower due to the lower peak temperatures.

It is anticipated that the weight of this engine would be slightly higher than the weight of a conventional internal combustion engine, but there would be provided an increase of efficiency and more reliable operation while providing an engine which would be simpler and easier to maintain.

The engine, of course, as described can be employed in helicopter or aircraft applications; which applications would avoid the use of the torque converter and hence could possess a greater horsepower to weight ratio than conventional internal combustion engines.

It is thus seen that there are many advantages available in the implementation of an engine as described above in regard to efficiency and use.

It should also be evident that many alternate ways of accomplishing or designing particular components of this engine should be apparent to those skilled in the art from a reading of the above specification and hence, all such embodiments are considered to be part of this invention.

I claim:

1. A controlled pulse turbine engine, comprising:

(a) turbine means having a shaft rotatably coupled thereto for supplying power to a load, said turbine means driven by a nozzle adapted to receive compressed gas for rotation of said turbine and hence, said shaft, (b) a combustor-compressor means having a piston assembly adapted to move in a relatively linear path, said piston assembly comprising first and second high pressure cylinders, each having a separate actuatable piston, a crosspiece block, means coupling each of said pistons to said crosspiece block, a low pressure cylinder having a actuatable piston capable of moving upon application thereto of a substantially lower pressure than that accommodated by said high pressure cylinders and upon moving to cause a charge of air to be conducted from the atmosphere into said low pressure cylinder, said piston coupled to said crosspiece block by means of at least one piston rod, and thrust counter-force means coupled to said crosspiece block for maintaining equilibrium of said piston assembly, while constraining said assembly to move in said linear path, (c) servo means operative to monitor the rotation of said turbine and operative to develop a signal for activating either one of said high pressure cylinders to move said two high pressure pistons, said low pressure piston as coupled thereto and said crosspiece block in a linear path, (d) exhaust means coupled to said high pressure cylinders to provide a series of pulses at an output, each pulse in said series manifesting a charge of hot compressed gas indicative of always the same fuel charge generated by the motion of said high pressure pistons within said associated cylinder, (e) means for applying said pulse series to said turbine nozzle for rotation of said shaft, and (f) means for conducting compressed air charges emitted from said low pressure cylinder into either of said high pressure cylinders.

2. The turbine engine according to claim 1 wherein said servo means includes a speed sensor device, comprising:

(a) an inner wheel fabricated from a magnetizable material, said wheel coupled to said shaft associated with said turbine to rotate with said shaft, a plurality of projections equally dispersed about the periphery of said inner wheel, (b) an outer wheel rotatably mounted in concentric relationship to said inner wheel and having at least one projection extending towards said inner wheel, (c) means coupled to said one projection and responsive to the alignment of said projection to one of said projections on said inner wheel to provide a first signal when aligned and a second signal when said projections are not aligned, and (d) means coupled to said outer wheel for rotating the same at a relatively constant speed whereby said first and second signals as provided during rotation, are indicative of the difference in velocity of rotation between said shaft and said relatively constant speed whereby said signals are indicative of the rotational speed of said turbine.

3. The turbine engine according to claim 1 further comprising:

(a) electric fuel injecting means coupled to said servo means for discharging a stream of fuel into a selected one of said high pressure cylinders according to said signal, (b) means for selecting said high pressure cylinders to cause said stream of fuel to be selectively injected into either of said first or second cylinders as selected whereby fuel is injected alternately into said first and then into said second high pressure cylinders.

4. The engine according to claim 1 further including a pressure chamber coupled between said high pressure and low pressure cylinders to store therein, a pressure of a predetermined value.

5. The engine according to claim 1 wherein said thrust counter-force means includes at least two thrust rods, each pivotally coupled to said crosspiece block at one end and selectively constrained at said other end to define a relatively linear path of motion in a direction relatively perpendicular to the path of said crosspiece block; torsion bar means for generating equal and opposite forces to be applied to said selectively constrained ends of said thrust rods and in the direction of motion of said constrained ends.

6. The engine according to claim 1 wherein said servo means includes a trigger generator responsive to said signal for generating an electrical pulse of a fixed duration and of a rate proportional to said rotation of said turbine.

7. The control pulse turbine engine according to claim 1 further including:

(a) a flywheel coupled to said turbine shaft and operative to store kinetic energy for predetermined periods.

* * * * *